US010969711B2

(12) United States Patent
Kojima

(10) Patent No.: US 10,969,711 B2
(45) Date of Patent: Apr. 6, 2021

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Hiroomi Kojima, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/910,458

(22) Filed: Jun. 24, 2020

(65) Prior Publication Data

US 2021/0003944 A1 Jan. 7, 2021

(30) Foreign Application Priority Data

Jul. 2, 2019 (JP) ..... JP2019-123618

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

| | | | |
|---|---|---|---|
| 9,034,476 B2 | 5/2015 | Uchida et al. | |
| 9,753,411 B2 | 9/2017 | Uchida et al. | |
| 9,933,713 B2 | 4/2018 | Uchida | |
| 2020/0174405 A1* | 6/2020 | Uchida | C08K 5/43 |

FOREIGN PATENT DOCUMENTS

| | | |
|---|---|---|
| JP | 2007-241307 | 9/2007 |
| JP | 2008-274286 | 11/2008 |
| JP | 2015-230456 | 12/2015 |

* cited by examiner

*Primary Examiner* — Clayton E. LaBalle
*Assistant Examiner* — Michael A Harrison
(74) *Attorney, Agent, or Firm* — Venable LLP

(57) ABSTRACT

An electrophotographic belt whose surface barely peels off even after long-term repeated use is provided. The electrophotographic belt includes a layer including a thermoplastic resin composition containing a thermally melt kneaded product including a thermoplastic polyester resin, an ionic electro-conductive agent having a sulfonimide structure as an anion, and an amide compound having at least two amide groups in one molecule.

17 Claims, 5 Drawing Sheets

ELECTROPHOTOGRAPHIC BELT AND ELECTROPHOTOGRAPHIC IMAGE FORMING APPARATUS

BACKGROUND OF THE INVENTION

Field of the Invention

The present disclosure relates to electrophotographic belts, and electrophotographic image forming apparatuses including the electrophotographic belts.

Description of the Related Art

Japanese Patent Application Laid-Open No. 2015-230456 proposes an electro-conductive belt having high conductivity and a small variation in electric resistance even after long-term use. This electro-conductive belt contains an ionic liquid in a thermoplastic resin such as polyester, the ionic liquid containing a fluorinated sulfonimide structure or hexafluorophosphate as an anion.

According to the examination by the present inventors, a toner image carrying surface of the electrophotographic belt according to Japanese Patent Application Laid-Open No. 2015-230456 were sometimes partially peeled off accompanied by repeated use in the electrophotographic image forming apparatus. When such an electrophotographic belt having a toner image carrying surface partially peeled was continuously used to form electrophotographic images, dot-like white spots were generated in positions corresponding to the peeled portions in the resulting electrophotographic images in some cases. It is believed that such white spots are generated due to a difference in adhesive strength of toners between peeled portions and unpeeled portions of the toner image carrying surface of the electrophotographic belt.

One aspect of the present disclosure is directed to providing an electrophotographic belt whose surface barely peels off even after long-term repeated use. Another aspect of the present disclosure is directed to providing an electrophotographic image forming apparatus which can stably form high-quality electrophotographic images.

SUMMARY OF THE INVENTION

According to one aspect of the present disclosure, there is provided an electrophotographic belt including a first layer containing a thermoplastic resin composition containing a thermally melt kneaded product including a thermoplastic polyester resin, an ionic electro-conductive agent having a sulfonimide structure as an anion, and an amide compound having at least two amide groups in one molecule and having a molecular weight of 1000 or less.

According to another aspect of the present disclosure, there is provided an electrophotographic image forming apparatus including the electrophotographic belt as an intermediate transfer belt.

Further features of the present invention will become apparent from the following description of exemplary embodiments with reference to the attached drawings.

BRIEF DESCRIPTION OF THE DRAWINGS

FIG. 5B-1 is a cross-sectional view of an electrophotographic belt taken along line A-A' of FIG. 5A, the electrophotographic belt having a monolayer structure.

FIG. 5B-2 is a cross-sectional view of an electrophotographic belt taken along line A-A' of FIG. 5A, the electrophotographic belt having a laminate structure.

DESCRIPTION OF THE EMBODIMENTS

Figure 1:
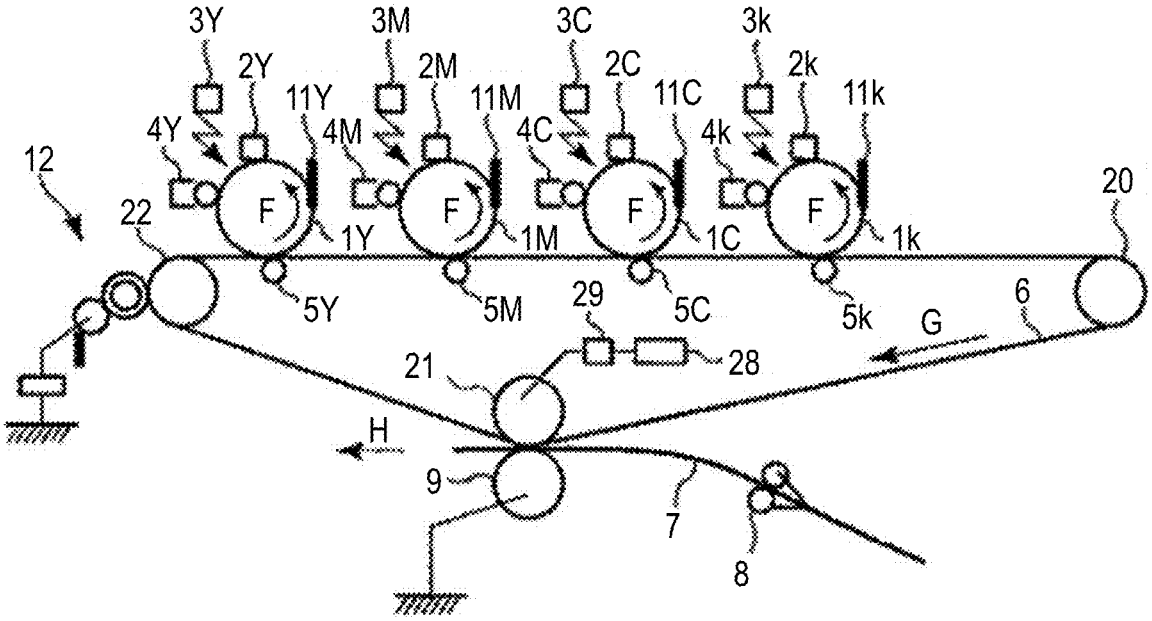
FIG. 1 is a cross-sectional schematic view illustrating one example of a full-color electrophotographic image forming apparatus using an electrophotographic process.

Preferred embodiments of the present invention will now be described in detail in accordance with the accompanying drawings.

The electrophotographic belt according to one aspect of the present disclosure includes a first layer containing a thermoplastic resin composition containing a thermally melt kneaded product including a thermoplastic polyester resin, an ionic electro-conductive agent having a sulfonimide structure as an anion, and an amide compound having at least two amide groups in one molecule and having a molecular weight of 1000 or less.

The present inventors consider the following reason why irregular peel-off is generated in the toner image carrying surface (hereinafter, also referred to as "outer surface") of the electrophotographic belt according to Japanese Patent Application Laid-Open No. 2015-230456.

That is, for example, the polyester resin and the ionic electro-conductive agent contained in the thermoplastic resin composition are not completely compatible, and microscopically, a phase containing the polyester resin (hereinafter, also referred to as "PE phase") and a phase containing the ionic electro-conductive agent (hereinafter, also referred to as "IA phase") are mixed. For this reason, it is believed that the interface between the PE phase and the IA phase peels off when the outer surface of the electrophotographic belt is subjected to repeated friction by a cleaning blade or paper sheets.

The present inventors, who have conducted further intensive research in consideration of the above findings, have found that peel-off of the outer surface of the electrophotographic belt can be reduced by containing a thermally melt kneaded product of a thermoplastic polyester resin, an ionic electro-conductive agent having a sulfonimide structure as an anion, and a compound having at least two amide groups in one molecule in the first layer forming the outer surface, in the case of an electrophotographic belt having a monolayer structure, for example.

The present inventors also have found that in an electrophotographic belt having a laminate structure including a first layer as a base layer, and a second layer disposed on the base layer as a surface layer to form a toner image carrying surface, partial peel-off of the second layer together with the first layer can be reduced by containing a thermally melt kneaded product of a thermoplastic polyester resin, an ionic electro-conductive agent having a sulfonimide structure as an anion, and a compound having at least two amide groups in one molecule in the first layer, and thus peel-off of the outer surface of the electrophotographic belt can be reduced.

The present inventors consider the following reason why the peel-off of the outer surface of the electrophotographic belt having the first layer can be reduced even after repeated use thereof. That is, at least one amide group of the compound bonds to an ester bond of the polyester resin through interaction such as a hydrogen bond, and at least one another amide group bonds to a sulfonimide group of the ionic electro-conductive agent through interaction such as a hydrogen bond or sulfonamidation. As a result, the affinity at the interface between the PE phase and the IA phase is enhanced to reduce the interfacial peeling of the PE phase and the IA phase.

The present inventors also have confirmed that the surface peel-off can be reduced by the same mechanism as above even if the thermoplastic resin composition further contain polyether ester amide (PEEA) in addition to the thermally melt kneaded product. PEEA has an ester bond and an amide group in one molecule to function as a high-molecular ionic electro-conductive agent.

<Thermoplastic Resin Composition>

The thermoplastic resin composition can be prepared by thermally melt kneading at least a thermoplastic polyester resin, an ionic electro-conductive agent having a sulfonimide structure as an anion, and a compound having at least two amide groups in one molecule. PEEA may be thermally melt kneaded with these components.

The term "thermal melt kneading" means that a resin contained in the thermoplastic resin composition is melted by heating and kneaded. During thermal melt kneading, the resins can be kneaded at a temperature equal to or higher than the highest melting point such that among the resins contained in the thermoplastic resin composition, the resin having the highest melting point is well kneaded. Any kneading method can be used without limitation, and a single screw extruder, a twin screw kneader extruder, a Banbury mixer, a roll, a Brabender, a Plastograph, or a kneader can be used.

<Thermoplastic Polyester Resin>

The thermoplastic polyester resin can be prepared through polycondensation of a dicarboxylic acid and a diol, polycondensation of an oxycarboxylic acid or lactone, or polycondensation using a plurality of these components, for example. An additional polyfunctional monomer may also be used in combination. The thermoplastic polyester resin may be a homopolyester having one ester bond or may be a copolyester (copolymer) having a plurality of ester bonds.

Suitable examples of the thermoplastic polyester resin include at least one thermoplastic polyester resin selected from the group consisting of polyalkylene terephthalates and polyalkylene naphthalates having high crystallinity and high heat resistance. A copolymer of a polyalkylene terephthalate and a polyalkylene isophthalate can be suitably used.

The copolymer at this time may be in the form of a block copolymer or a random copolymer.

In polyalkylene terephthalate, polyalkylene naphthalate, and polyalkylene isophthalate, alkylenes having 2 or more and 16 or less carbon atoms are preferred from the viewpoint of high crystallinity and heat resistance. More specifically, preferred as the thermoplastic polyester resin are polyethylene terephthalate, polyethylene naphthalate, and a copolymer of polyethylene terephthalate and polyethylene isophthalate.

The thermoplastic polyester resin has an intrinsic viscosity of preferably 1.4 dl/g or less, more preferably 0.3 dl/g or more and 1.2 dl/g or less. A thermoplastic polyester resin having an intrinsic viscosity of 1.4 dl/g or less has high fluidity during thermal melt kneading. An intrinsic viscosity of 0.3 dl/g or more further facilitates an enhancement of the strength and the durability of the electrophotographic belt.

The intrinsic viscosity of the thermoplastic polyester resin is measured using o-chlorophenol as a solvent for diluting a thermoplastic polyester resin and setting a concentration of an o-chlorophenol solution of the thermoplastic polyester resin at 0.5% by mass and a temperature at 25° C.

The content of the thermoplastic polyester resin in the thermoplastic resin composition is preferably 50% by mass or more, more preferably 60% by mass or more, still more preferably 70% by mass or more based on the total mass of the thermoplastic resin composition. By controlling the content of the thermoplastic polyester resin to 50% by mass or more based on the total mass of the thermoplastic resin composition, the mechanical strength of the thermoplastic resin composition can be readily enhanced.

<Ionic Electro-Conductive Agent Having Sulfonimide Structure>

An ionic electro-conductive agent having a sulfonimide structure as an anion to be used can be an ionic liquid having an anion represented by Structural formula (1). The ionic liquid is a liquid consisting of only ions, and indicates a salt present in the state of a liquid at a wide range of temperature, particularly, a salt formed of a relatively large organic ion species to have a melting point of 100° C. or less.

Structural formula (1)

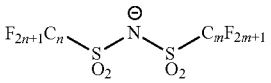

In Structural formula (1), m and n each independently represent an integer of 1 or more and 4 or less.

Specific examples of the anion satisfying Structural formula (1) include bis(trifluoromethanesulfonyl)imide ion, bis(perfluoroethanesulfonyl)imide ion, bis(perfluoropropanesulfonyl)imide ion, bis(perfluorobutanesulfonyl)imide ion, trifluoromethanesulfonylperfluoropropanesulfonylimide ion, and trifluoromethanesulfonylperfluorobutanesulfonylimide ion.

The counterpart of the anion represented by Structural formula (1) can be any cation without limitation. Examples of such cations include ammonium ions, imidazolium ions, pyridinium ions, piperidinium ions, pyrolidinium ions, and phosphonium ions. Among these, preferred are ammonium ions, particularly quaternary ammonium ions and imidazolium ions from the viewpoint of cost.

Specific examples of the ammonium ions include N,N,N-trimethyl-N-propylammonium ion (TMPA), N,N,N-tributyl-N-methylammonium ion, N,N,N-trioctyl-N-methylammonium ion, N-butyl-N,N,N-trimethylammonium ion, N-(tert-butyl)-N,N,N-trimethylammonium ion, N-phenyl-N,N,N-trimethylammonium ion, and N-(2,4,6-trimethylphenyl)-N,N,N-trimethylammonium ion.

Specific examples of the imidazolium ions include 1-ethyl-3-methylimidazolium ion, 1-butyl-3-methylimidazolium ion, 1-hexyl-3-methylimidazolium ion, 1-methyl-3-octylimidazolium ion, 1-(tert-butyl)-3-methylimidazolium ion, 1-phenyl-3-methylimidazolium ion, and 1-(2,4,6-trimethylphenyl)-3-methylimidazolium ion.

Specific examples of the pyridinium ions include 1-ethylpyridinium ion, 1-butylpyridinium ion, 1-hexylpyridinium ion, 1-(tert-butyl)pyridinium ion, 1-phenylpyridinium ion, and 1-(2,4,6-trimethylphenyl)pyridinium ion.

Specific examples of the piperidinium ions include N-methyl-N-ethylpiperidinium ion, N-methyl-N-propylpiperidinium ion, N-(tert-butyl)-N-methylpiperidinium ion, N-phenyl-N-methylpiperidinium ion, and N-(2,4,6-trimethylphenyl)-N-methylpiperidinium ion.

Specific examples of the pyrolidinium ions include N-methyl-N-propylpyrolidinium ion, N-methyl-N-butylpyrolidinium ion, N-(tert-butyl)-N-methylpyrolidinium ion, N-phenyl-N-methylpyrolidinium ion, and N-(2,4,6-trimethylphenyl)-N-methylpyrolidinium ion.

Specific examples of the phosphonium ions include trimethylpropylphosphonium ion, tributylmethylphosphonium ion, triethylpentylphosphonium ion, (tert-butyl)-trimethylphosphonium ion, phenyl-trimethylphosphonium ion, and (2,4,6-trimethylphenyl)-trimethylphosphonium ion.

These anions and cations may be used alone or in combination. The ionic electro-conductive agent can be composed of a combination of one or more these anions and cations.

From the viewpoint of the electric resistance of the electrophotographic belt, the content of the ionic electro-conductive agent in the first layer is preferably 0.5% by mass or more based on the total amount of the thermoplastic resin composition. An amount of more than 15% by mass leads to difficulties in further reducing the electric resistance. Thus, the content of the ionic electro-conductive agent is preferably 15% by mass or less from the viewpoint of the molding properties.

<Amide Compound Having at Least Two Amide Groups in One Molecule>

The amide compound having at least two amide groups in one molecule (hereinafter, simply referred to as "amide compound") has a molecular weight of 1000 or less. The amide compound has a molecular weight of particularly preferably 200 or more and 800 or less.

It is considered that the amide compound having a molecular weight within this range interacts with the polyester resin and the ionic electro-conductive agent in the first layer to enhance the affinity at the interface between the PE phase and the IA phase.

The amide compound is preferably a compound that melts at a heating temperature during thermal melt kneading.

The melting point is preferably 70° C. or more and less than 200° C., more preferably 100° C. or more and less than 170° C. An amide compound having a melting point within this range can have high dispersibility and distributional ability in the thermoplastic resin composition during thermal melt kneading, can be readily arranged between molecules of the thermoplastic polyester resin and the ionic electro-conductive agent, and barely decomposes due to thermal degradation. For these reasons, the effect of reducing the peel-off of the outer surface of the electrophotographic belt can be further enhanced.

The amide compound is preferably a fatty acid bisamide. The fatty acid bisamide has a fatty acid group (preferably a long-chain fatty acid group) and amide groups in the molecule, has high miscibility with the thermoplastic polyester resin, and is thermally and chemically relatively stable. From the viewpoint of the miscibility with the thermoplastic polyester resin and the thermal and chemical stability, the long-chain fatty acid group preferably has 7 to 23 carbon atoms. An aromatic bisamide may be used as the compound having at least two amide groups. The aromatic bisamide has a fatty acid group and amide groups in the molecule, where the amide groups bond to each other with an aromatic hydrocarbon.

Examples of usable fatty acid bisamides include alkylene fatty acid bisamides such as ethylene fatty acid bisamide. Specific examples include methylene bisstearamide (melting point (Tm): 142° C.), ethylene biscapric acid amide (Tm: 161° C.), ethylene bislauric acid amide (Tm: 157° C.), ethylene bisstearamide (Tm: 145° C.), ethylene bishydroxystearamide (Tm: 145° C.), ethylene bisbehenic acid amide (Tm: 142° C.), hexamethylene bisstearamide (Tm: 140° C.), hexamethylene bisbehenic acid amide (Tm: 142° C.), hexamethylene bishydroxystearamide (Tm: 135° C.), N,N'-distearyladipic acid amide (Tm: 141° C.), N,N'-distearylsebacic acid amide (Tm: 136° C.), ethylene bisoleamide (Tm: 115° C.), ethylene biserucamide (Tm: 120° C.), hexamethylene bisoleamide (Tm: 110° C.), N,N'-dioleyladipic acid amide (Tm: 118° C.), and N,N'-dioleylsebacic acid amide (Tm: 113° C.).

The content of the amide compound is preferably 0.5% by mass or more and 50.0% by mass or less based on the amount of the ionic electro-conductive agent having a sulfonimide structure. The content is more preferably 0.8% by mass or more and 30.0% by mass or less.

The content of 0.5% by mass or more is preferred because a large number of amide groups interacts with the thermoplastic polyester resin and the ionic electro-conductive agent to enhance the peel strength. The content of 50.0% by mass or less suppresses a reduction in melt viscosity of the thermoplastic resin composition, and readily suppresses a reduction in strength of the electrophotographic belt. A reduction in mobility of the ionic electro-conductive agent is suppressed, and an increase in resistance of the electrophotographic belt is readily suppressed.

<Polyether Ester Amide (PEEA)>

Examples of the PEEA include compounds containing, as a main component, a copolymer composed of a polyamide block unit and a polyether ester unit, such as nylon 6, nylon 66, nylon 11, and nylon 12. Examples thereof include copolymers derived from salts of lactams (such as caprolactam and lauryllactam) or aminocarboxylic acids, polyethylene glycol, and dicarboxylic acids. Specific examples of the dicarboxylic acids include terephthalic acid, isophthalic acid, adipic acid, azelaic acid, sebacic acid, undecanedioic acid, and dodecanedioic acid. The PEEA can be produced by a known polymerization method such as melt polymerization. Of course, any other PEEA can be used without limitation. The PEEA may be a blend or an alloy of two or more PEEAs.

According to the present disclosure, the amide compound having at least two amide groups in one molecule indicates a low molecular compound having a molecular weight of 1000 or less. In contrast, the PEEA is a high molecular compound having a molecular weight larger than that, and does not correspond to the amide compound having at least two amide groups in one molecule according to the present disclosure.

In the thermoplastic resin composition containing the PEEA, the content of the compound having at least two amide groups in one molecule is preferably 0.3% by mass or more and 15.0% by mass or less based on the total amount of the ionic electro-conductive agent having a sulfonimide structure and the PEEA. The content is more preferably 0.6% by mass or more and 12.0% by mass or less. The content of 0.3% by mass or more is preferred because a large number of amide groups interacts with the thermoplastic polyester resin, the ionic electro-conductive agent, and the PEEA to enhance the peel strength. The content of 15.0% by mass or less suppresses a reduction in melt viscosity of the thermoplastic resin composition, and readily suppresses a reduction in strength of the electrophotographic belt. A reduction in mobility of the ionic electro-conductive agent is suppressed, and an increase in resistance of the electrophotographic belt is readily suppressed.

<Additives>

The thermoplastic resin composition may contain other components in the range not impairing the effects of the present disclosure. Examples of the other components include conductive high-molecular compounds, antioxidants, ultraviolet absorbing agents, organic pigments, inorganic pigments, pH adjusters, cross-linking agents, compatibilizers, mold release agents, cross-linking agents, coupling agents, lubricants, insulation fillers, and conductive fillers. These additives may be used alone or in combination. The amounts of the additives to be used can be appropriately set without limitation.

<Electrophotographic Belt>

Figure 5A:
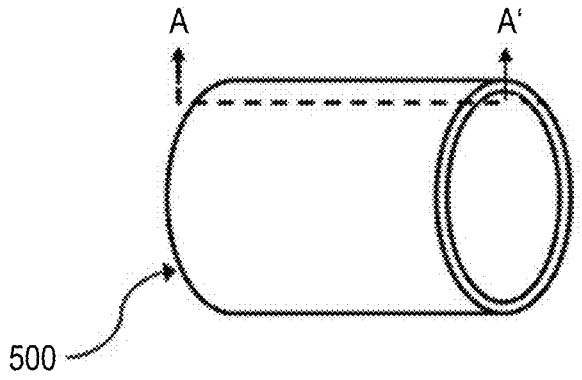
FIG. 5A is a perspective view illustrating an electrophotographic belt having an endless belt shape.
Figures 1, 5B:
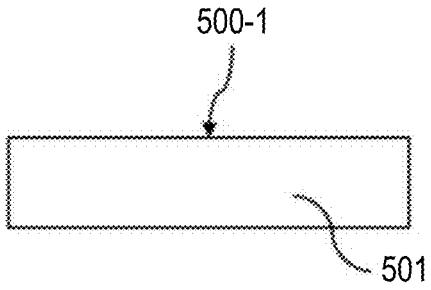
Figures 2, 5B:
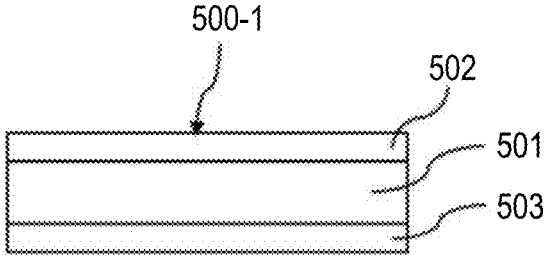

FIG. 5A illustrates a perspective view of an electrophotographic belt 500 in the form of an endless belt according to one aspect of the present disclosure. Examples of the layer configuration include a monolayer structure including only a first layer 501 containing the thermoplastic resin composition as illustrated in FIG. 5B-1, which illustrates a cross section taken along line A-A' of FIG. 5A. In this case, an outer surface 500-1 of the first layer corresponds to the toner carrying surface of the electrophotographic belt.

Figure 2:
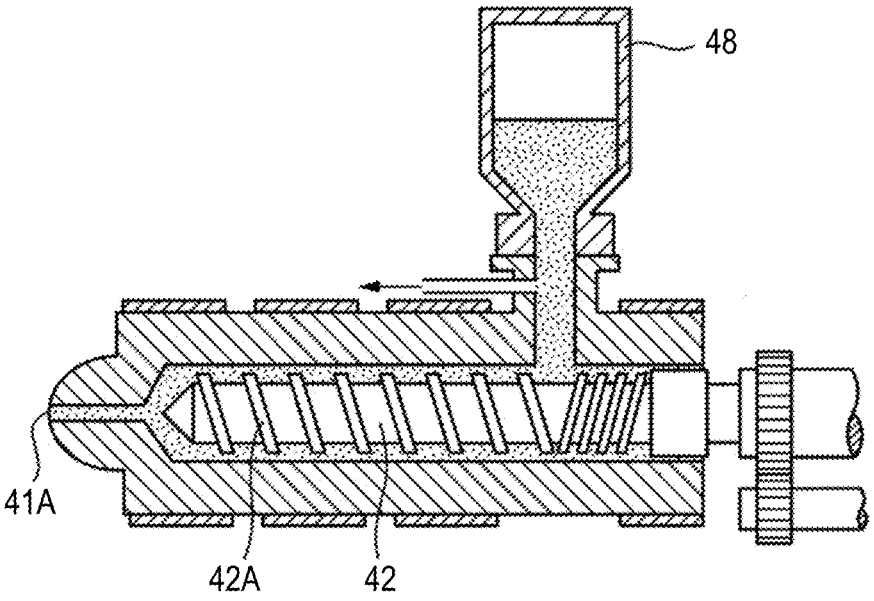
FIG. 2 is a cross-sectional schematic view illustrating the injection molding apparatus used in Examples.

Other examples thereof include a laminate structure, as illustrated in FIG. 5B-2, including a first layer 501 and at least one of a second layer 502 coating the outer peripheral surface of the first layer and a third layer 503 coating the inner circumferential surface of the first layer. If the second layer 502 is disposed, the outer surface 500-1 of the second layer 502 corresponds to the toner carrying surface of the electrophotographic belt.

Examples of the second layer include layers containing cured products of active energy beam-curable resins and having high resistance to wear. Such a second layer can be disposed, for example, by applying a composition containing an active energy beam-curable resin, such as a photocurable resin, onto the outer peripheral surface of the first layer, and curing the resin.

Examples of the third layer include resin layers for reinforcing the first layer, and electro-conductive layers for imparting electro-conductivity to the inner circumferential surface of the electrophotographic belt.

The first layer in the form of an endless belt can be prepared by the following method, for example.

i) A method of melt extruding a mixture of a thermoplastic polyester resin, an ionic electro-conductive agent having a sulfonimide structure as an anion, and a compound having at least two amide groups in one molecule into a cylindrical shape.

ii) A method of molding pellets of the thermoplastic resin composition into a shape of an endless belt using a molding method such as injection molding, stretch blow molding, or inflation molding.

Among these, examples of the method i) include an inner cooling mandrel method of a downward extrusion type enabling high precision control of the inner diameter of an extruded tube, and a vacuum sizing method.

The method of producing an electrophotographic belt by stretch blow molding in the method ii) involves the following steps. That is, a step of molding a preform of the thermoplastic resin composition; a step of heating the preform; a step of attaching the preform after heating to a metal mold for molding an endless belt, and subsequently, introducing a gas into the metal mold to perform stretch blow molding; and a step of cutting the stretch molding product prepared by stretch blow molding to prepare an endless belt.

The first layer has a thickness of preferably 40 μm or more and 500 μm or less, particularly preferably 50 μm or more and 100 μm or less.

To improve the appearance of the surface of the electrophotographic belt and the releasing properties of the toner, a treatment agent may be applied to the surface of the thermoplastic resin composition layer, or a surface treatment such as polishing may be performed thereon. An outermost layer may be disposed on the surface of the thermoplastic resin composition layer by sputtering.

The electrophotographic belt can be used in any application without limitation. For example, the electrophotographic belt is suitably used as an intermediate transfer belt for temporary transfer and carry of a toner image, or a conveying transfer belt for conveying a recording material as a transfer material. In particular, the electrophotographic belt can be suitably used as an intermediate transfer belt. If the electrophotographic belt is used as an intermediate transfer belt, the electrophotographic belt preferably has a surface intrinsic resistivity of $1\times10^{3}\Omega/\square$ or more and $1\times10^{12}\Omega/\square$ or less. If the surface intrinsic resistivity is $1\times10^{3}\Omega/\square$ or more, a reduction in resistance can be prevented, a transfer electric field can be readily obtained, and lack or roughness of images can be effectively prevented. If the surface intrinsic resistivity is $1\times10^{12}\Omega/\square$ or less, an increase in transfer voltage can be more effectively suppressed, and an increase in electrical power source and/or an increase in cost can be effectively suppressed.

<Electrophotographic Image Forming Apparatus>

An example of an electrophotographic image forming apparatus including the electrophotographic belt according to one aspect of the present disclosure as an intermediate transfer belt will now be described. As illustrated in FIG. 1, the electrophotographic image forming apparatus has a so-called tandem configuration in which electrophotographic stations of several colors are arranged in the rotational direction of the intermediate transfer belt. Although symbols Y, M, C, and k are given to configurations related with colors of yellow, magenta, cyan, and black, respectively, in the following description, those symbols may be omitted if their configuration is the same.

In FIG. 1, charging apparatuses 2Y, 2M, 2C, and 2*k*, exposure apparatuses 3Y, 3M, 3C, and 3*k*, developing apparatuses 4Y, 4M, 4C, and 4*k*, and an intermediate transfer belt (intermediate transfer member) 6 are arranged around photoreceptor drums (photosensitive members, image bearing members) 1Y, 1M, 1C, and 1*k*. Each photoreceptor drum 1 is rotatably driven in the direction of the arrow F at a predetermined circumferential speed (process speed). Each charging apparatus 2 charges the circumferential surface of the corresponding photoreceptor drum 1 to a predetermined polarity and a predetermined potential (primary charge). A laser beam scanner as the exposure apparatus 3 outputs laser light on/off modulated corresponding to the image information input from an image scanner (not illustrated) or an external apparatus such as a computer to perform scan and exposure on the charged surface of the photoreceptor drum 1. As a result of this scan and exposure, an electrostatic latent image corresponding to the target image information is formed on the surface of the photoreceptor drum 1.

The developing apparatuses 4Y, 4M, 4C, and 4*k* contain the toners of color components of yellow (Y), magenta (M), cyan (C), and black (k), respectively. The developing apparatus 4 to be used is selected based on the image information to develop the developer (toner) on the surface of the photoreceptor drum 1. Thus, the electrostatic latent image is visualized as a toner image. The present embodiment uses a reversal development method of developing the toner applied to exposed portions of the electrostatic latent image. Moreover, such a charging apparatus, exposure apparatus, and developing apparatus form an electrophotographic image forming means.

The intermediate transfer belt 6 having an endless belt shape is arranged in contact with the surfaces of the photoreceptor drums 1, and extends on a plurality of extension rollers 20, 21, and 22. The intermediate transfer belt 6 is configured to rotate in the direction of the arrow G. In the present embodiment, the extension roller 20 is a tension roller which controls the tension of the intermediate transfer belt 6 to a predetermined tension, the extension roller 22 is a drive roller for the intermediate transfer belt 6, and the extension roller 21 is a facing roller for secondary transfer. Primary transfer rollers 5Y, 5M, 5C, and 5*k* are arranged in primary transfer positions facing the photoreceptor drums 1, respectively, with the intermediate transfer belt 6 interposed therebetween.

The unfixed toner images of the corresponding colors formed on the photoreceptor drums 1 are sequentially primarily transferred in an electrostatic manner onto the intermediate transfer belt 6 by applying a primary transfer bias having a polarity opposite to the charged polarity of the toners to the primary transfer rollers 5 from a constant voltage source or a constant current source. Thus, a full-color image formed of a laminate of the unfixed toner images of the four colors is formed on the intermediate transfer belt 6. The intermediate transfer belt 6 rotates while carrying the toner images transferred from the photoreceptor drums 1. The surfaces of the photoreceptor drums 1 are cleaned by the corresponding cleaning apparatuses 11 to remove transfer residual toners for every one rotation of the photoreceptor drum 1 after primary transfer, and then the image forming process is repeated.

A secondary transfer roller (transfer unit) 9 is disposed by pressure welding on the side of the toner image carrying surface of the intermediate transfer belt 6 in the secondary transfer position of the intermediate transfer belt 6 facing the conveying path of a recording material 7. The facing roller 21 is arranged on the side of the rear surface of the intermediate transfer belt 6 in the secondary transfer position thereof. The facing roller 21 forms a counter electrode of the secondary transfer roller 9, and a bias is applied to the facing roller 21. When the toner image of the intermediate transfer belt 6 is transferred onto the recording material 7, a bias having the same polarity as that of the toner, for example, −1000 to −3000 V, is applied to the facing roller 21 by a transfer bias applying unit 28, and a current of −10 to −50 μA flows. The transfer voltage at this times is detected by a transfer voltage detection unit 29. Furthermore, a cleaning apparatus (belt cleaner) 12 is disposed downstream of the secondary transfer position to remove residual toners on the intermediate transfer belt 6 after secondary transfer.

The recording material 7 is conveyed through a convey guide 8 in the direction of the arrow H, and is introduced to the secondary transfer position. The recording material 7 introduced to the secondary transfer position is held and conveyed in the secondary transfer position. At this time, a constant voltage bias (transfer bias) controlled to a predetermined value is applied from the secondary transfer bias applying unit 28 to the facing roller 21 for the secondary transfer roller 9. By applying the transfer bias having the same polarity to that of the toner to the facing roller 21, the full-color image (toner image) formed of the four colors layered on the intermediate transfer belt 6 at the transfer site is transferred in batch onto the recording material 7 to form an unfixed full-color toner image on the recording material. The recording material 7 having the transferred toner image is introduced into a fixing unit (not illustrated), and is fixed by heating.

According to one aspect of the present disclosure, an electrophotographic belt whose surface barely peels off even after long-term repeated use can be obtained. According to another aspect of the present disclosure, an electrophotographic image forming apparatus which can stably form high-quality electrophotographic images can be obtained.

EXAMPLES

Examples and Comparative Examples will now be shown to specifically describe the present disclosure, but the present disclosure should not be limited to the configuration embodied in Examples.

The materials shown in Tables 1 to 4 were prepared as materials (the thermoplastic polyester resin, the ionic electro-conductive agent, the amide compound, and polyether ester amide) used in preparation of the electrophotographic belts according to Examples and Comparative Examples. Amide compounds 1 to 5 shown in Table 3 correspond to the compound having at least two amide groups in one molecule. In contrast, Amide compound 6 does not correspond to the compound.

TABLE 1

| <Thermoplastic polyester resin> | |
|---|---|
| Polyester resin 1 | Polyethylene terephthalate (Trade name: TRN-8550FF, manufactured by TEIJIN LIMITED) |
| Polyester resin 2 | Polyethylene naphthalate (Trade name: TN-8050SC, manufactured by TEIJIN LIMITED) |

TABLE 2

| <Ionic electro-conductive agent> | |
|---|---|
| Ionic electro-conductive agent 1 | N,N,N-Trioctyl-N-methylammonium-bis(trifluoromethanesulfonyl)imide (Trade name: MTOA-TFSI, manufactured by Toyo Gosei Co., Ltd.) |
| Ionic electro-conductive agent 2 | N,N,N-Tributyl-N-methylammonium-bis(trifluoromethanesulfonyl)imide (Trade name: FC-4400, manufactured by 3M Japan Limited) |
| Ionic electro-conductive agent 3 | N-Butyl-N,N,N-trimethylammonium-bis(trifluoromethanesulfonyl)imide (Butyltrimethylammonium bis(trfluoromethanesulfonyl)imide) (manufactured by KANTO CHEMICAL CO., INC.) |
| Ionic electro-conductive agent 4 | 1-Ethyl-3-methylimidazolium-bis(trifluoromethanesulfonyl)imide (Trade name: EMI-TFSI, manufactured by KISHIDA CHEMICAL Co., Ltd.) |
| Ionic electro-conductive agent 5 | 1-Butylpyridinium-bis(trifluoromethanesulfonyl)imide(1-Butylpyridinium bis (trfluoromethanesulfonyl)imide) (manufactured by KANTO CHEMICAL CO., INC.) |

TABLE 3

| <Amide compound> | |
|---|---|
| Amide compound 1 | Ethylene bisstearamide (Trade name: Denon PB-1239, manufactured by Marubishi Oil Chemical Corporation) Melting point = 145° C., Molecular weight = 593 |

TABLE 3-continued

| <Amide compound> | |
|---|---|
| Amide compound 2 | Ethylene biscapric acid amide (Trade name: SLIPACKS C, manufactured by Mitsubishi Chemical Corporation) Melting point = 161° C., Molecular weight = 401 |
| Amide compound 3 | Ethylene bisbehenic acid amide (Trade name: SLIPACKS B, manufactured by Mitsubishi Chemical Corporation) Melting point = 142° C., Molecular weight = 689 |
| Amide compound 4 | Hexamethylene bisstearamide (Trade name: SLIPACKS ZHS, manufactured by Mitsubishi Chemical Corporation) Melting point = 140° C., Molecular weight = 641 |
| Amide compound 5 | Ethylene bisoleamide (Trade name: ALFLOW AD-281F, manufactured by NOF CORPORATION) Melting point = 115° C., Molecular weight = 589 |
| Amide compound 6 | Stearic acid monoamide (Trade name: ALFLOW S-10, manufactured by NOF CORPORATION) Melting point = 103° C., Molecular weight = 283 |
| Nylon 1 | Polyethylene oxide block nylon 12 copolymer (Trade name: IrgastatP16, manufactured-by Ciba Specialty Chemicals Inc.) Weight average molecular weight = 10000 or more |

TABLE 4

| <Polyether ester amide (PEEA)> | |
|---|---|
| PEEA1 | Polyether ester amide (Trade name: TPAE H151, manufactured by T&K TOKA) |
| PEEA2 | Polyether ester amide (Trade name: PELESTAT NC6321, manufactured by Sanyo Chemical Industries, Ltd.) |

(Methods of Measuring and Evaluation Property Values)

Methods (1) to (4) of evaluating the electrophotographic belts according to Examples and Comparative Examples will now be described. The recording material used in the image formation for the evaluation below was a paper sheet of size A4 having an arithmetic average roughness Ra of 4 μm and a ten-point height of irregularities Rzjis of 15 μm after left in an environment at a temperature of 23° C. and a relative humidity of 45% for one day.

(1) Surface Intrinsic Resistivity

The surface intrinsic resistivity of the electrophotographic belt was measured by a method according to JIS-K6911. The measurement apparatus used was a high resistance meter (trade name: Hiresta UPMCP-HT450; manufactured by Mitsubishi Chemical Analytech Co., Ltd.) including a main electrode having an inner diameter of 50 mm, a guard ring electrode having an inner diameter of 53.2 mm, and a probe (trade name: UR-100; manufactured by Mitsubishi Chemical Analytech Co., Ltd.) having an outer diameter of 57.2 mm.

A prepared electrophotographic belt was left in a test room to stand for 12 hours in an environment controlled to a temperature of 23° C. and a relative humidity of 50%. Subsequently, a voltage of 250 V was applied to the target electrophotographic belt for 10 seconds under an environment at a temperature of 23° C. and a relative humidity of 50%, and the surface intrinsic resistivity thereof was measured at four places of the electrophotographic belt in the circumferential direction thereof. The average (ρs) of the obtained surface intrinsic resistivities was converted into a logarithm log ρs (where the base was 10), which was defined as an index for electric resistance. The value shown under "Surface intrinsic resistivity" in Table 7 is the value of log ρs.

(2) The Initial Number of Surface Peels

Using an adhesive properties tester (trade name: Multi-cross hatch cutter 295; manufactured by ERICHSEN GmbH & Co. KG), a 10 mm×10 mm square region of the surface of a prepared electrophotographic belt was cut in the longitudinal direction and the traverse direction at a width of 1 mm and a depth of about 10 μm. A polyester adhesive tape (trade name: No. 31B., manufactured by NITTO DENKO CORPORATION) was strongly pressed against with a finger and bonded to the cut square region, and was left to stand for about 1 minute. The adhesive tape had a length of 130 mm and a width of 22 mm.

Subsequently, an end of the adhesive tape was fixed to a light load type adhesive/coating film peel analyzer (trade name: VPA-3., manufactured by Kyowa Interface Science Co., Ltd.) while the angle of the end was kept at 45°, and the adhesive tape was peeled at a rate of 150 mm/sec. Among the cuts in the 100 squares within the square region, the number of cuts adhering to the adhesive tape was counted.

(3) The Number of Surface Peels after Durability Test

A prepared electrophotographic belt was mounted on a drum cartridge of a full-color electrophotographic image forming apparatus (trade name: LBP-5200, manufactured by Canon Inc.) as an intermediate transfer belt. Using the electrophotographic image forming apparatus, a cyan toner and a magenta toner were layered to form a violet solid image, and 20000 sheets of a recording material having such a violet solid image were output. Subsequently, the electrophotographic belt was removed from the electrophotographic image forming apparatus, and the toners were removed from the surface thereof by air blowing air. Thereafter, the same test as in (2) above was performed.

(4) The Number of Images Having White Spots after Durability Test

The number of images having white spots was visually measured in the image formed on the 20000th sheet of recording material output in "(3) The number of surface peels after durability test" above.

Examples 1 to 15

The materials were preblended according to the composition shown in Table 5. Using a twin screw extruder (trade name: TEX44a, manufactured by The Japan Steel Works, Ltd.), the materials were thermally melt kneaded to prepare a thermoplastic resin composition in the form of pellets. The temperature for thermal melt kneading was controlled within the range of 270° C. or more and 300° C. and less, and the time for thermal melt kneading was about 3 minutes.

The resulting thermoplastic resin composition in the form of pellets was dried at a temperature of 140° C. for 6 hours. In the next step, the dried thermoplastic resin composition in the form of pellets was placed into a hopper 48 of an injection molding apparatus (trade name: SE180D, manufactured by Sumitomo Heavy Industries, Ltd.) having the configuration illustrated in FIG. 2.

The temperature of the cylinder was set to 290° C., and the thermoplastic resin composition was melted inside screws 42 and 42A. The melted thermoplastic resin composition was injection molded through a nozzle 41A into a metal mold (not illustrated) to prepare a preform 104 (see FIG. 3). The temperature for the injection molding metal mold at this time was 30° C.

Figure 3:
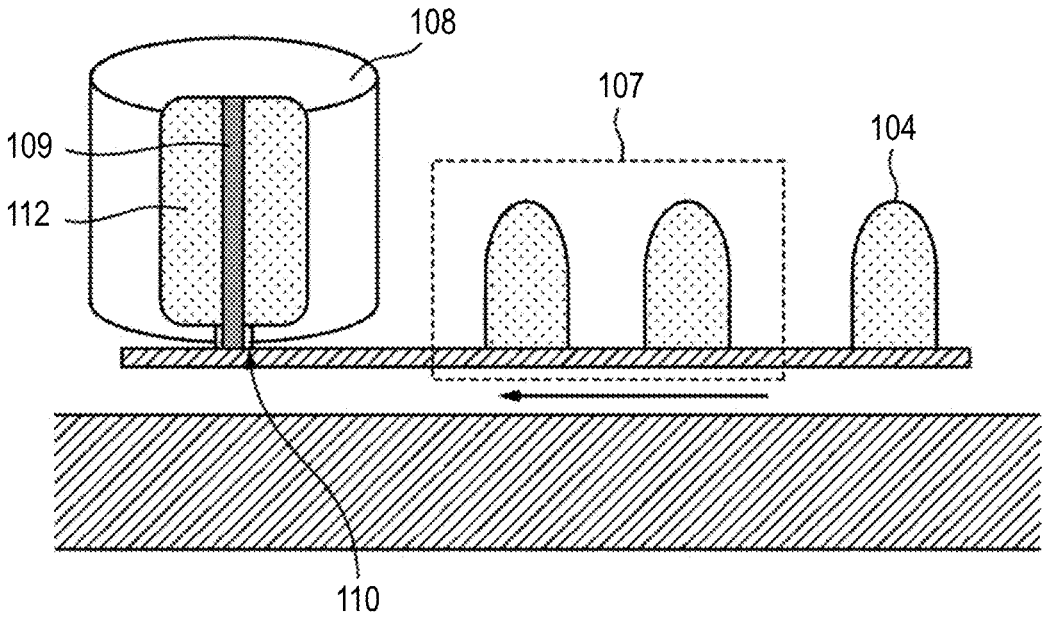
FIG. 3 is a cross-sectional schematic view illustrating the primary blow molding apparatus used in Examples.

In the next step, the preform 104 was placed in a 500° C. heater 107 of a primary blow molding apparatus illustrated in FIG. 3 to be softened, and the preform 104 was heated at 500° C. Using a stretch rod 109 and air force (blow air injection portion 110), the preform 104 was blow molded in a blow metal mold 108 whose temperature was kept at room temperature, where the preform temperature was 160° C., the air pressure was 0.3 MPa, and the rate of a stretch rod was 1000 mm/s. A blow bottle 112 was thereby obtained.

Figure 4:
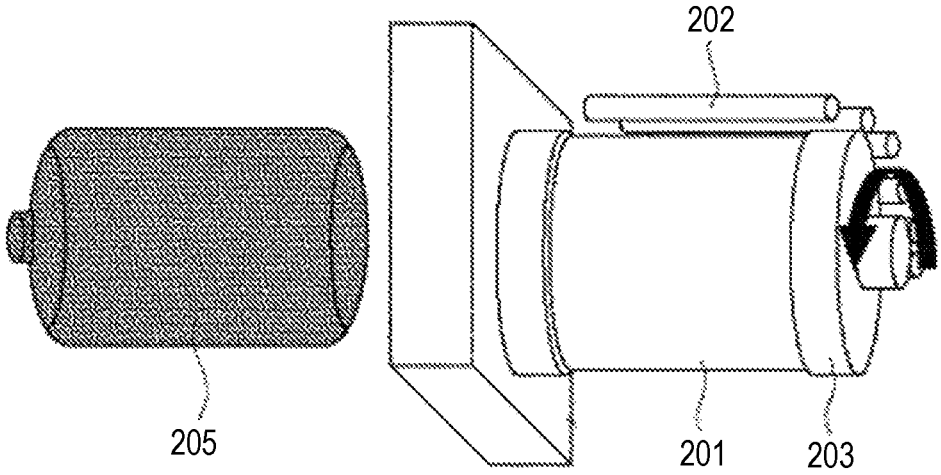
FIG. 4 is a cross-sectional schematic view illustrating the secondary blow molding apparatus used in Examples.

In the next step, the resulting blow bottle 205 was set in a nickel cylindrical metal mold 201, which was prepared by electrocasting, in the secondary blow molding apparatus illustrated in FIG. 4, and an external mold 203 was attached. The blow bottle 205 was transferred to the inner surface of the metal mold by applying air into the blow bottle 205 at a pressure of 0.1 MPa and adjusting the pressure so as not to leak the air to the outside, and was uniformly heated at 190° C. for 60 seconds in total with a heater 202 while the nickel cylindrical metal mold 201 was being rotated.

Subsequently, the nickel cylindrical metal mold was cooled to normal temperature by blowing air thereto, and the pressure applied into the blow bottle was released to obtain a blow bottle having a size improved by annealing. The blow bottle was cut at both ends to obtain an electrophotographic belt having a monolayer structure composed of only a first layer. The resulting electrophotographic belt had a thickness of 70 μm. The results of evaluations (1) to (4) performed on the electrophotographic belts are shown in Tables 5-1 to 5-2.

TABLE 5-1

| | | Example | | | | | | | | | |
|---|---|---|---|---|---|---|---|---|---|---|---|
| | | 1 | 2 | 3 | 4 | 5 | 6 | 7 | 8 | 9 | 10 |
| Composition | Polyester resin 1 [% by mass] | 98.47 | 90.4 | — | — | — | — | — | — | 85.0 | 63.5 |
| | Polyester resin 2 [% by mass] | — | — | 97.4 | 87.2 | 95.2 | 82.1 | 92.2 | 77.0 | — | — |
| | Ionic electro-conductive agent 1 [% by mass] | 1.5 | 1.5 | — | — | — | — | — | — | — | — |
| | Ionic electro-conductive agent 2 [% by mass] | — | — | 2.5 | 2.5 | — | — | — | — | — | — |
| | Ionic electro-conductive agent 3 [% by mass] | — | — | — | — | 4.5 | 4.5 | — | — | — | — |
| | Ionic electro-conductive agent 4 [% by mass] | — | — | — | — | — | — | 7.0 | 7.0 | — | — |
| | Ionic electro-conductive agent 5 [% by mass] | — | — | — | — | — | — | — | — | 13.0 | 13.0 |
| | Amide compound 1 [% by mass] | 0.03 | 0.08 | — | — | — | — | — | — | — | — |
| | Amide compound 2 [% by mass] | — | — | 0.1 | 0.3 | — | — | — | — | — | — |
| | Amide compound 3 [% by mass] | — | — | — | — | 0.3 | 0.4 | — | — | — | — |
| | Amide compound 4 [% by mass] | — | — | — | — | — | — | 0.8 | 1.0 | — | — |
| | Amide compound 5 [% by mass] | — | — | — | — | — | — | — | — | 2.0 | 3.5 |
| | PEEA1 [% by mass] | — | 8.0 | — | — | — | 13.0 | — | — | — | 20.0 |
| | PEEA2 [% by mass] | — | — | — | 10.0 | — | — | — | 15.0 | — | — |
| | Amide compound/ionic electro-conductive agent [%] | 2.00 | 5.33 | 4.00 | 12.00 | 6.67 | 8.89 | 11.43 | 14.29 | 15.38 | 26.92 |
| | Amide compound/(ionic electro-conductive agent + PEEA) [%] | — | 0.84 | — | 2.40 | — | 2.29 | — | 4.55 | — | 10.61 |
| Results of evaluations | Surface intrinsic resistivity [logρs] | 9.70 | 9.30 | 9.50 | 9.00 | 9.10 | 8.67 | 8.74 | 8.52 | 8.57 | 8.37 |
| | The initial number of surface peels | 4 | 3 | 3 | 1 | 0 | 0 | 1 | 2 | 2 | 3 |
| | The number of surface peels after durability test | 6 | 7 | 5 | 3 | 2 | 2 | 3 | 4 | 3 | 5 |
| | The number of images having white spots after durability test | 0 | 0 | 0 | 0 | 0 | 0 | 0 | 0 | 0 | 0 |

TABLE 5-2

| | | Example | | | | |
|---|---|---|---|---|---|---|
| | | 11 | 12 | 13 | 14 | 15 |
| Composition | Polyester resin 1 [% by mass] | — | — | — | 94.0 | 78.7 |
| | Polyester resin 2 [% by mass] | 89.8 | 84.6 | 79.4 | — | — |
| | Ionic electro-conductive agent 1 [% by mass] | 3.5 | 3.5 | 3.5 | — | — |
| | Ionic electro-conductive agent 2 [% by mass] | — | — | — | 6.0 | 6.0 |
| | Ionic electro-conductive agent 3 [% by mass] | — | — | — | — | — |
| | Ionic electro-conductive agent 4 [% by mass] | — | — | — | — | — |
| | Ionic electro-conductive agent 5 [% by mass] | — | — | — | — | — |
| | Amide compound 1 [% by mass] | — | — | — | — | — |
| | Amide compound 2 [% by mass] | 0.2 | 0.4 | 0.6 | — | — |
| | Amide compound 3 [% by mass] | — | — | — | 0.05 | 0.30 |
| | Amide compound 4 [% by mass] | — | — | — | — | — |
| | Amide compound 5 [% by mass] | — | — | — | — | — |
| | PEEA1 [% by mass] | 10.0 | 15.0 | 20.0 | — | — |
| | PEEA2 [% by mass] | — | — | — | — | 15.0 |
| | Amide compound/ionic electro-conductive agent [%] | 5.71 | 11.43 | 17.14 | 0.83 | 5.00 |
| | Amide compound/(ionic electro-conductive agent + PEEA) [%] | 1.48 | 2.16 | 2.55 | — | 1.43 |
| Results of evaluations | Surface intrinsic resistivity [logρs] | 8.97 | 8.73 | 8.61 | 8.92 | 8.62 |
| | The initial number of surface peels | 3 | 1 | 2 | 5 | 4 |
| | The number of surface peels after durability test | 6 | 3 | 5 | 8 | 6 |
| | The number of images having white spots after durability test | 0 | 0 | 0 | 0 | 0 |

Examples 16 to 20

Electrophotographic belts each having a laminate structure including a first layer and a second layer coating the outer peripheral surface of the first layer were prepared as follows.

That is, first, each electrophotographic belt including only a first layer was prepared in the same manner as in Example 1 except that the composition according to Table 6 was used. In the next step, a surface layer containing a cured product of an acrylic resin, which was an active energy beam-curable resin, was disposed on the outer peripheral surface of the electrophotographic belt as follows.

The following materials were mixed.

100 parts by mass of dipentaerythritol hexaacrylate (trade name: LIGHT ACRYLATE DPE-6A, manufactured by Kyoeisha Chemical Co., Ltd.).

15 parts by mass of carbon black (ketjen black) (trade name: MHI black #273, manufactured by Mikuni-Color Ltd.).

5 parts by mass of photopolymerization initiator (trade name: IRGACURE (registered trademark) 184, manufactured by BASF Japan Ltd.).

The mixture was diluted with methyl ethyl ketone to give a resin solid content of 6% by mass, and was stirred with a stirrer to prepare a coating material for forming a surface layer. The coating material was applied by spraying to the outer peripheral surface of the electrophotographic belt prepared above to form a coating. The coating was dried at a temperature of 60° C. for 1 minute to remove the solvent. Using an ultraviolet light irradiator (trade name: UE06/81-3, manufactured by Eye Graphics Co., Ltd.), the coating was cured by irradiating the coating with ultraviolet light until the accumulated light amount reached 1000 mJ/cm$^2$. Thus, an electrophotographic belt having a laminate structure in which the outer peripheral surface of the first layer was coated with the second layer containing a cured product of the active energy beam-curable resin was prepared. The second layer had a thickness of 2 μm. The results of evaluations (1) to (4) of the resulting electrophotographic belts are shown in Table 6.

TABLE 6

| | | Example | | | | |
|---|---|---|---|---|---|---|
| | | 16 | 17 | 18 | 19 | 20 |
| Composition | Polyester resin 1 [% by mass] | 90.4 | — | — | — | 63.5 |
| | Polyester resin 2 [% by mass] | — | 87.2 | 82.1 | 77.0 | — |
| | Ionic electro-conductive agent 1 [% by mass] | 1.5 | — | — | — | — |
| | Ionic electro-conductive agent 2 [% by mass] | — | 2.5 | — | — | — |
| | Ionic electro-conductive agent 3 [% by mass] | — | — | 4.5 | — | — |
| | Ionic electro-conductive agent 4 [% by mass] | — | — | — | 7.0 | — |
| | Ionic electro-conductive agent 5 [% by mass] | — | — | — | — | 13.0 |
| | Amide compound 1 [% by mass] | 0.08 | — | — | — | — |
| | Amide compound 2 [% by mass] | — | 0.3 | — | — | — |
| | Amide compound 3 [% by mass] | — | — | 0.4 | — | — |
| | Amide compound 4 [% by mass] | — | — | — | 1.0 | — |
| | Amide compound 5 [% by mass] | — | — | — | — | 3.5 |
| | PEEA1 [% by mass] | 8.0 | — | 13.0 | — | 20.0 |
| | PEEA2 [% by mass] | — | 10.0 | — | 15.0 | — |
| | Amide compound/ionic electro-conductive agent [%] | 5.33 | 12.00 | 8.89 | 14.29 | 26.92 |
| | Amide compound/(ionic electro-conductive agent + PEEA) [%] | 0.84 | 2.40 | 2.29 | 4.55 | 10.61 |
| Results of evaluations | Surface intrinsic resistivity [logρs] | 9.30 | 9.00 | 8.67 | 8.52 | 8.37 |
| | The initial number of surface peels | 2 | 1 | 0 | 0 | 1 |
| | The number of surface peels after durability test | 4 | 2 | 0 | 1 | 3 |
| | The number of images having white spots after durability test | 0 | 0 | 0 | 0 | 0 |

As shown in Tables 5-1, 5-2, and 6, in all the electrophotographic belts in Examples 1 to 20, only slight surface peel was observed in the evaluation of surface peel, and preferable image quality after the solid image was output after the durability test was obtained.

Comparative Examples 1 to 11

Electrophotographic belts were prepared in the same manner as in Example 1 except that the type of material and the compounding amount were as shown in Table 7. The results of evaluations are shown in Table 7.

TABLE 7

| | | Comparative Example | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Composition | Polyester resin 1 [% by mass] | 98.50 | 98.47 | 90.42 | 95.50 | — | — | — | — | 85.00 | 63.50 | 63.50 |
| | Polyester resin 2 [% by mass] | — | — | — | — | 95.2 | 82.1 | 92.2 | 77.0 | — | — | — |

TABLE 7-continued

| | | Comparative Example | | | | | | | | | | |
|---|---|---|---|---|---|---|---|---|---|---|---|---|
| | | 1 | 2 | 3 | 4 | 5 | 6 | 7 | 8 | 9 | 10 | 11 |
| | Ionic electro-conductive agent 1 [% by mass] | 1.5 | 1.5 | 1.5 | — | — | — | — | — | — | — | — |
| | Ionic electro-conductive agent 2 [% by mass] | — | — | — | — | — | — | — | — | — | — | — |
| | Ionic electro-conductive agent 3 [% by mass] | — | — | — | 4.5 | 4.5 | 4.5 | | | — | — | — |
| | Ionic electro-conductive agent 4 [% by mass] | — | — | — | — | — | — | 7.0 | 7.0 | — | — | — |
| | Ionic electro-conductive agent 5 [% by mass] | — | — | — | — | — | — | — | — | 13.0 | 13.0 | 13.0 |
| | Amide compound 6 [% by mass] (one amide group) | — | 0.03 | 0.08 | — | 0.3 | 0.4 | 0.8 | 1.0 | 2.0 | 3.5 | — |
| | Nylon 1 | — | — | — | — | — | — | — | — | — | — | 3.5 |
| | PEEA1 [%by mass] | — | — | 8.0 | — | — | 13.0 | — | — | — | 20.0 | 20.0 |
| | PEEA2 [% by mass] | — | — | — | — | — | — | — | 15.0 | — | — | — |
| | Amide compound/ionic electro-conductive agent [%] | — | 2.00 | 5.33 | — | 6.67 | 8.89 | 11.43 | 14.29 | 15.38 | 26.92 | 26.92 |
| | Amide compound/(ionic electro-conductive agent + PEEA) [%] | — | — | 0.84 | — | — | 2.29 | — | 4.55 | — | 10.61 | 10.61 |
| Results of evaluations | Surface intrinsic resistivity [logρs] | 9.70 | 9.70 | 9.30 | 9.10 | 9.10 | 8.67 | 8.74 | 8.52 | 8.57 | 8.37 | 8.37 |
| | The initial number of surface peels | 33 | 41 | 45 | 50 | 46 | 56 | 59 | 65 | 69 | 78 | 62 |
| | The number of surface peels after durability test | 43 | 50 | 54 | 58 | 59 | 63 | 68 | 75 | 82 | 91 | 76 |
| | The number of images having white spots after durability test | 11 | 12 | 14 | 19 | 20 | 23 | 24 | 26 | 28 | 31 | 25 |

In Comparative Examples 1 and 4, the first layer did not contain any amide compound.

In Comparative Examples 2, 3, and 5 to 10, the first layer contained stearic acid monoamide having one amide group.

Furthermore, in Comparative Example 11, the first layer contained nylon having two or more amide groups but having a molecular weight which was significantly larger than 1000.

In these Comparative Examples, a large number of surface peels was observed in the evaluations of surface peel at the initial stage and after the durability test, and a large number of images having white spots was observed as a result of evaluation of the image after the solid image was output onto 20000 sheets of paper.

From these results, it is understood that it is essential to a reduction in peel of the outer surface of the electrophotographic belt that an amide compound having at least two amide groups in one molecule and having a molecular weight of 1000 or less is contained in a first layer including a thermoplastic polyester resin and an ionic electro-conductive agent having a sulfonimide structure as an anion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-123618, filed Jul. 2, 2019, which is hereby incorporated by reference herein in its entirety.

What is claimed is:

1. An electrophotographic belt comprising a first layer containing a thermoplastic resin composition containing a thermally melt kneaded product including:

a thermoplastic polyester resin;

an ionic electro-conductive agent having a sulfonimide structure as an anion; and an amide compound having at least two amide groups in one molecule and having a molecular weight of 1000 or less.

2. The electrophotographic belt according to claim 1, wherein the ionic electro-conductive agent is an ionic liquid containing an anion having a structure represented by Structural formula (1):

Structural formula (1)

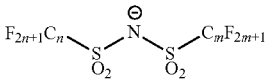

where m and n each independently represent an integer of 1 or more and 4 or less.

3. The electrophotographic belt according to claim 1, wherein the thermoplastic polyester resin contains at least one selected from the group consisting of polyalkylene terephthalates and polyalkylene naphthalates.

4. The electrophotographic belt according to claim 3, wherein the polyalkylene terephthalate is polyethylene terephthalate.

5. The electrophotographic belt according to claim 4, wherein the polyalkylene naphthalate is polyethylene naphthalate.

6. The electrophotographic belt according to claim 1, wherein the amide compound is at least one selected from the group consisting of fatty acid bisamides and aromatic bisamides.

7. The electrophotographic belt according to claim 6, wherein the fatty acid bisamide is ethylene bisfatty acid amide.

8. The electrophotographic belt according to claim 1, wherein the amide compound has a melting point of 70° C. or more and less than 200° C.

9. The electrophotographic belt according to claim 1, a counterpart cation to the anion of the ionic electro-conductive agent is at least one cation selected from the group consisting of ammonium ions, imidazolium ions, pyridinium ions, piperidinium ions, pyrolidinium ions and phosphonium ions.

10. The electrophotographic belt according to claim 1, wherein a content of the ionic electro-conductive agent is 0.5% by mass or more and 15% by mass or less based on the total amount of the thermoplastic resin composition.

11. The electrophotographic belt according to claim 1, wherein a content of the amide compound is 0.5% by mass or more and 50.0% by mass or less based on the content of the ionic electro-conductive agent.

12. The electrophotographic belt according to claim 1, wherein the thermoplastic resin composition contains polyether ester amide.

13. The electrophotographic belt according to claim 12, wherein the content of the amide compound is 0.3% by mass or more and 15% by mass or less based on the total amount of the ionic electro-conductive agent and the polyether ester amide.

14. The electrophotographic belt according to claim 1, further comprising a second layer containing a cured product of a composition comprising an active energy beam curable resin.

15. The electrophotographic belt according to claim 1, wherein the electrophotographic belt has an endless belt shape.

16. The electrophotographic belt according to claim 15, wherein the second layer coats an outer peripheral surface of the first layer.

17. An electrophotographic image forming apparatus including an intermediate transfer belt, wherein the intermediate transfer belt is an electrophotographic belt comprising a first layer containing a thermoplastic resin composition containing a thermally melt kneaded product including:

a thermoplastic polyester resin;

an ionic electro-conductive agent having a sulfonimide structure as an anion; and an amide compound having at least two amide groups in one molecule and having a molecular weight of 1000 or less.

* * * * *